US005082456A

United States Patent [19]

Lan

[11] Patent Number: 5,082,456

[45] Date of Patent: Jan. 21, 1992

[54] CONNECTOR

[76] Inventor: Shirley S. Lan, 26 Ocean St., Millburn, N.J. 07041

[21] Appl. No.: 397,400

[22] Filed: Aug. 23, 1989

[51] Int. Cl.[5] ..... H01R 11/24

[52] U.S. Cl. ..... 439/504; 439/817

[58] Field of Search ..... 439/345, 503, 504, 506, 439/513, 786, 817, 819, 828, 829, 835, 759, 761, 861, 754, 756, 832, 909

[56] References Cited

U.S. PATENT DOCUMENTS 2,012,770 8/1935 Quintavalle ..... 439/817

FOREIGN PATENT DOCUMENTS 0394220 1/1909 France ..... 439/817

2702648 6/1978 W. Germany ..... 439/506

*Primary Examiner*—Eugene F. Desmond

*Attorney, Agent, or Firm*—Sandler, Greenblum, & Bernstein

[57] ABSTRACT

A connector for a cable which includes a housing and the two clamping strips which are bent at their front ends and extend outwardly from an opening in the housing.

31 Claims, 2 Drawing Sheets

CONNECTOR

BACKGROUND OF THE INVENTION

1. Field of the Invention

The present invention relates to connectors and more particularly to connectors for use at the end of cables and the like. Specifically, the connector of the present invention is attached to the end of the electrical cable. In any case, the connector includes a clamp to permit the connector to be fastened to an object by the use of a pushing action.

2. Background of the Invention

Conventional electrical connectors, for example, for booster cables, as shown in FIG. 4, are formed as clamps. The clamps are formed by pivoting two metal clamping body pieces together via a pivot. In addition, there is a coil spring located on the pivoting axis of each of the metal clamping pieces. The front ends of the metal clamp pieces are provided with jaw portions for attachment to either the positive or negative terminals of a battery by a clamping action, or any place necessary to have a proper electrical connection. The coil spring is a biasing coil and provides the requisite clamping force for the jaws. The rear end of the metal clamp is provided with a terminal for connecting the clamp to an electrical booster cable. The end of the clamp opposite from the jaws is in the form of a grip or handle. With the structure of the conventional clamp, the clamp can be opened manually by squeezing the grip with the hand. The jaws can then be placed on the battery terminals or other contact portions for proper electrical connection when the pressure of the hand squeezing the grip is released to permit the spring to bias the jaws against the surface.

Although conventional clamps perform their intended function, such clamps have some disadvantages. One problem is that the clamp is typically relatively large because the pivoting pin and biasing spring are located on the central portion of the two metal clamping pieces. Due at least in part to this structure, the two ends opposite the jaw clamping portions remain in a relatively wide open state when the clamp is not used. Accordingly, more space is required for storage.

Another problem with conventional clamps is that the two front ends of the jaw portion can be easily contaminated by dirt, grease and the like because the two front ends are exposed unless covered.

An additional problem of the traditional clamps is that the jaw portion can only be opened by a squeezing force of the hand thus making it difficult for a person who does not have sufficient hand squeezing force to easily open the jaws.

SUMMARY OF THE INVENTION

In a preferred embodiment, the present invention provides a specific connector with a clamp structure wherein a pushing force is utilized to actuate the clamp instead of the traditional squeezing force to open the jaws of the electrical clamp. This structure not only is easier to use, but provides more convenience during use.

Because a pushing force is utilized to operate the jaws, the shape of the clamp is completely different as compared with the conventional clamp. The present clamp has only two outwardly extending and bent jaws exposed, the rest of the parts of the clamp are housed inside a tubular insulator member which acts as a base for the clamp. With this structure storage is easier and the size of the clamp is reduced compared to a conventional battery cable clamp. This assembly also protects the clamp from contamination by dirt or grease.

In accordance with the present invention, the connector for attachment to a cable or similar object includes a tubular member with an elongated opening in which means for attaching to an object are disposed. The means for attaching includes a fixed clamping strip and a movable clamping strip that are connected to each other for relative movement. The connection is made by an elastic or a resilient means for connection, such as a coil spring which also provides the necessary force for imparting a clamping action.

The movable and fixed clamping strips each have a front bent portion extending beyond the opening in the tubular member. The front bent portion of the movable clamp strip extends beyond the front bent portion of the fixed strip so that a clamping action is provided between the front bent portions. The fixed clamping strip is secured to the tubular member by a means for securing, such as set screw.

The tubular member which seats and houses the clamping strips is preferably made of insulative material, particularly where the connector is to be used for electrical connections.

The fixed clamp strip has a first elongated portion, a second portion substantially perpendicular to the first elongated portion, and a front bent portion extending over and spaced from the first elongated portion. The movable clamp strip has a first elongated portion and a second portion bent substantially perpendicular to the first elongated portion and a front bent portion spaced from and extending in an opposite direction from said elongated portion coil spring.

The connector assembly apparatus of the present invention also includes means, such as a coil spring, for securing the fixed and movable clamp strips together to provide a clamping force. The end of the front bent portion of the movable clamp strip extends beyond the end of the front bent portion of the fixed clamp strip. The front portions of the strips includes means for attaching the clamp strips for electrical connections, for example to a battery terminal.

The connector assembly apparatus of the present invention also includes means for securing the first clamp The clamp strips are preferably made of conductive material.

DETAILED DESCRIPTION OF THE PREFERRED EMBODIMENTS

Figure 1:
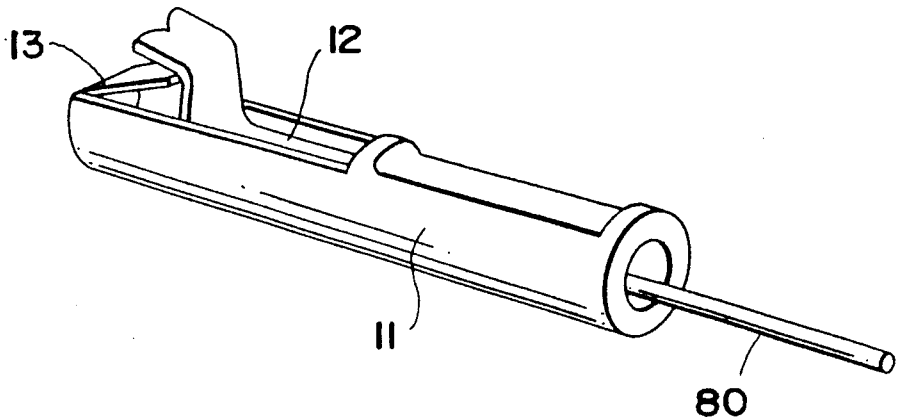
FIG. 1 is a plan view of the electrical connector of the present invention.
Figure 4:
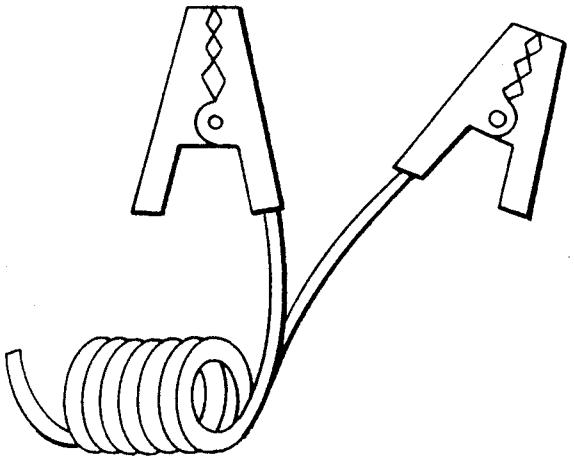
FIG. 4 PRIOR ART
FIG. 4 shows a prior art electrical clamp.
Figure 3:
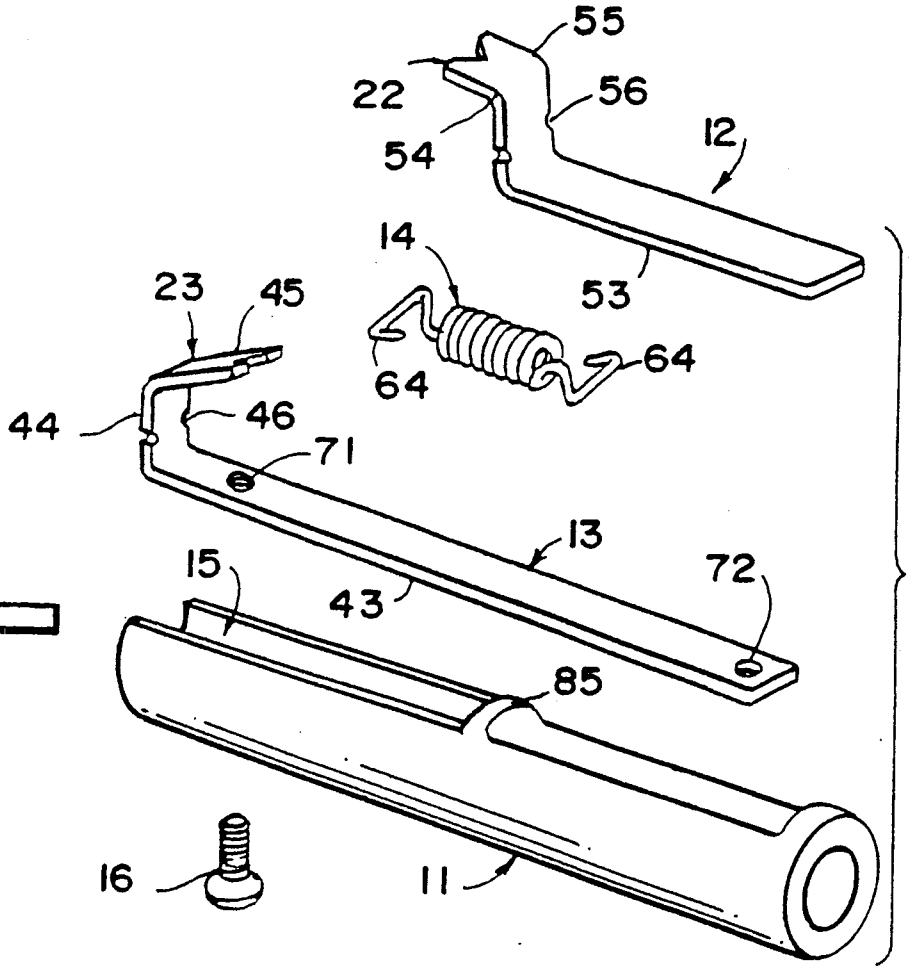
FIG. 3 is an exploded view of the electrical connector.
Figure 2:
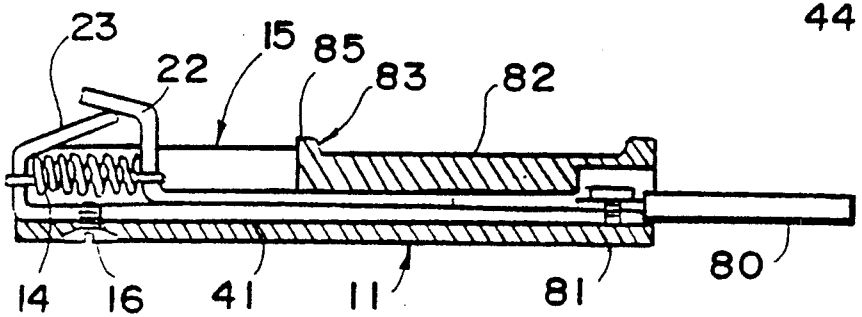
FIG. 2 shows a cut-away view of the electrical connector showing its internal structure.

Referring to FIGS. 1, 2 and 3 it can be seen that the present invention comprises a base member 11 and two clamping strips 12 and 13 which are housed inside the base member 11. The base member 11 is a generally elongate member having a hollow interior portion with an interior surface in communication with an open forward portion and a rearward portion, which has an upper side and wherein the open forward portion is a longitudinal slot in such upper side which is preferably open-ended at the forward end of the number. Most preferably the base member is tubular shaped and made of insulating material. The clamping strips 12 and 13 are preferably made of conductive material, such as metal. A coil spring 14 provides a clamping force to tie the jaws of the clamping strips 12 and 13 together.

As shown in FIG. 3, the base member 11 is provided with an elongated opening 15 along at least a portion of its surface. When the base member 11 is substantially hollow or preferably tubular shaped, the opening 15 forms a elongate slot in an upper surface of the base member or exposes an elongate area of the hollow center of the tube, for example as a trough, of sufficient size to accommodate the two metal clamping strips 12 and 13 which are placed into opening 15. Thus, clamping strips are housed within the elongate slot formed in the base member 11 by opening 15, or within the elongate area of the hollow center of the tubular-shaped elongate area of the hollow center of the tubular-shaped base member exposed by opening 15.

The two clamping strips 13 and 12 are provided, respectively, with a forward bent front end 22 and a rearward bent front end 23 comprising contact surfaces. As shown, the rearward bent front end 23 of clamping clip 13 is generally hook-shaped with a generally elongate section or shank portion 43 positioned to rest on a floor portion 41 of base member 11. Although the front end 23 may be bent into a substantially continuous curve, it preferred to bend the front end to form a front side or section 44 which is substantially flat and lies in a plane which is substantially perpendicular to a plane in which shank portion 43 lies, and a rearwardly bent free end section 45 which is substantially flat and lies in a plane which forms an acute angle with said plane in which shank portion 43 lies at a point in forward of said front side 44.

The clamping strip or slide element 12 also comprises a generally elongate slide section 53 which has a length which is preferably shorter than the length of the generally elongate portion of shank portion 43 of clamping strip 12 and a forward bent front portion end 22. Although the front end portion may also be bent into a substantially continuous curved configuration, it is preferred to bend the front end 22 to form a front side extending substantially perpendicularly from the slide portion 54, i.e., which is substantially flat and lies in a plane which is substantially perpendicular to a plane in which the generally elongate portion 53 lies, and a free forwardly projecting end section 55 which is substantially flat end lies in a plane which forms an acute angle with said plane in which said generally elongate slide section 53 lies at a point along the length of the slide section 53 to the rear of the free, forwardly projecting end section 54.

After the clamping strip 13 is seated in in base member 11, the clamping strip is fixed or fastened in position in the base member 11 by set screw 16, although any appropriate means for fastening can be used to fix clamping strip 13 in position to prevent it from sliding, including adhesive or plastic anchoring, in the base member 11.

The other clamping strip 12 is seated in position within base member 11 so that its slide section 53 is positioned to move along the generally elongate fixed element 43 of clamping strip 13 which is fixed via set screw 16 to an interior surface or floor base member 11. Coil spring 14 is used to tie the two metal clamping strips 12 and 13 together at their respective front end portions for forming a clamp between the respective forward bent end 22 and rearward bent end 23 of metal clamping strips 12 and 13. This is best seen in FIG. 2. In order to maintain the coil spring 14 in proper position in tying clamping strip 12 and clamping strip 13 together, the front side 44 of clamping strip 13 and the front side 54 of clamping strip 12 are each provided with a notch 46, 56, respectively, along at least one side edge in which hooked portions 64 of spring 14 are seated to minimize, and preferably prevent coil, spring 14 from sliding along either of the front sides 44 and 54 of clamping strips 13 and 12, respectively.

As shown more clearly in FIG. 2, the length of the generally elongate fixed element 43 of clamp strip 13 is preferably substantially the same as the length of the interior surface or floor of base member 11 and may be provided with at least one additional orifice 71, which is preferably towards a rear end opposite front side 44, for receiving screw 16 to more firmly attach clamping strip 13 to base member 11 The screw 16 also functions as a means for attaching a cable or similar article to the connector of the present invention.

The apparatus in accordance with the present invention has been discovered to be preferably used as an electrical connector and more preferably a battery jumper cable connector, wherein a wire or cable 80 for conducting electrical current from a source of electricity through the cable to clamping strips 12 and 13 is connected to the connector apparatus by screw 16 via clamping strip 13. Although, the clamp portion of the connector is preferably connected to an electrical booster cable by the use of a screw 16, other appropriate means for connection, including welding or soldering, to make the appropriate electrical connection may be used.

Referring again to FIG. 2, base member 11 comprises a solid upper portion 82 opposite floor portion 41 located at the rear of opening 15 wherein the front end 83 of the upper portion 82 forms a stop or an abutment, which preferably has an outwardly extending rib 85, to arrest rearward sliding movement of clamping strip 12; the forward sliding movement of clamping strip 12 is arrested when the free forward by projecting end section 55 is biased by coil spring 14 against the free end section inclined rearwardly. 54 of clamping strip 13.

The operation of the apparatus in accordance with the present invention will now be described in reference to FIGS. 1 and 2. After metal clamping strips 12 and 13 are seated in position inside base member 11, the only substantially portions which are exposed through opening 15 are bent ends 22 and 23. Inasmuch as the forward bent end 22 of the movable clamping strip 12 extends beyond the rearward bent end 23 of clamping strip 13 these two bent ends 22, 23 form an unsymmetrical clamp jaw. To use the connector, the user holds tubular insulating base member 11 by one hand with its clamping jaws facing away from the user, and preferably downwardly. The user then moves the assembly of the previously described elements in a generally forward direction until front end 22, which extends from the base member 11 a greater distance than front end 23, contacts an object to be clamped.

The connector is then pushed forward to open the clamping jaw until the upper jaw 23 is engaged on the other side of the object to be clamped, i.e., a battery terminal. Thereafter, when the user releases his hand from the base member 11, the jaws are biased by spring coil 14 to be clamped tightly on the object to be clamped, i.e., the electrical terminal of the battery (not shown), by the spring force from coil spring 14. To detach the clamp from the clamped object, the only thing that needs to be done is to hold the base member 11 by one hand, and then to push it slightly forward until the clamping jaw 23 is disengaged from the clamped object, i.e., the upper side of the electrical battery terminal. Upon releasing the pushing force, the clamp will be released from the electrical terminal of the battery.

While only one connector with its clamp is shown in FIGS. 1-3, it is fully within the scope of the invention to use as many connectors with a cable as are necessary to make a necessary connection. Moreover, as previously disclosed, the preferred embodiment of the present invention is the use of the connector with an electric wire or cable and more preferably with a battery booster cable. In such case, the connectors can be used with an auto, truck, boat, tractor type battery or with any battery where booster cables can be used. Notwithstanding the preferred embodiments, however, the connector has utility in many applications where a connector or fastener, such as a clamp, clasp, clip or similar device would be used, particularly a connector or fastener which is attached to a cable, chain, rope, string or similar article and is intended to be connected or fastened to another connector or object.

Although the invention has been described with reference to particular means, materials and embodiments, it is understood that the invention is not limited to the particulars disclosed, and extends to all equivalents within the scope of the claims.

I claim:

1. A connector comprising:

a) generally elongated member having a substantially elongated opening, said member having a hollow portion with an interior surface in communication with an open forward portion and a rearward portion;

b) means for connecting to an object, said means being positioned in said hollow portion, said means for connecting comprising a first contact surface and a second contact surface extending outwardly from said open forward portion of said generally elongated member; and c) means for slidably biasing said first contact surface and said second contact surface towards each other whereby said first contact surface and said second contact surface are separated from each other by applying a force against said second contact surface.

2. The connector of claim 1, wherein said means for connecting includes a generally elongate fixed element fastened to an interior surface of said hollow member, said generally elongate fixed element having a forward end comprising said first contact surface.

3. The connector of claim 1, wherein said generally elongate member has an upper side and said open forward portion is a longitudinal slot in said upper side of said generally elongate member.

4. The connector of claim 1, further comprising means for attaching an article to said means for connecting, with said means for attaching being fastened to said means for connecting.

5. A connector comprising:

a) generally elongated member having a substantially elongated opening, said member having a hollow portion with an interior surface in communication with an open forward portion and a rearward portion;

b) means for connecting to an object, said means being positioned in said hollow portion, said means for connecting comprising a first contact surface and a second contact surface extending outwardly from said open forward portion of said generally elongated member, said means for connecting including a generally elongate fixed element fastened to an interior surface of said hollow member, said generally elongate fixed element having a forward end comprising said first contact surface, and said forward end portion comprises a section extending substantially perpendicularly from an elongated section of said generally elongate fixed element; and c) means for biasing said first contact surface and said second contact surface towards each other whereby said first contact surface and said second contact surface are separated from each other by applying a force against said second contact surface.

6. The connector of claim 5, wherein said forward end portion comprises a free end section inclined rearwardly from said section extending substantially perpendicularly from said elongate section.

7. The connector of claim 5, wherein said means for connecting further comprises a slide element comprising said second contact surface, said slide element being mounted within said hollow member to move with respect to said elongate section of said generally elongate fixed element.

8. The connector of claim 7, wherein said slide element comprises a slide section in contact with said elongate section.

9. The connector of claim 8, wherein said slide element further comprises a section extending substantially perpendicularly from said slide section.

10. The connector of claim 9, wherein said slide element further comprises a free, forwardly projecting end section extending from said section extending substantially perpendicularly from said slide section towards said free end section of said generally elongate fixed element.

11. The connector of claim 9, wherein said means for biasing comprises a resilient member interconnecting said generally elongate fixed element and said slide element.

12. The connector according to claim 11, wherein said resilient member comprises a coil spring.

13. The connector according to claim 12, wherein said coil spring comprises opposite free ends connected to said section extending substantially perpendicularly from said elongate section of said generally elongate fixed element, and said section extending substantially perpendicular from said slide section.

14. A connector comprising:

a) generally elongated member having a substantially elongated opening, said member having a hollow portion with an interior surface in communication with an open forward portion and a rearward portion;

b) means for connecting to an object, said means being positioned in said hollow portion, said means for connecting comprising a first contact surface and a second contact surface extending outwardly from said open forward portion of said generally elongated member, said means for connecting including a generally elongate fixed element fastened to an interior surface of said hollow member, said generally elongate fixed element having a forward end comprising said first contact surface, and said forward end portion is substantially hook-shaped; and c) means for biasing said first contact surface and said second contact surface towards each other whereby said first contact surface and said second contact surface are separated from each other by applying a force against said second contact surface.

15. A connector comprising:

a) generally elongated member having a substantially elongated opening, said member having a hollow portion with an interior surface in communication with an open forward portion and a rearward portion;

b) means for connecting to an object, said means being positioned in said hollow portion, said means for connecting comprising a first contact surface and a second contact surface extending outwardly from said open forward portion of said generally elongated member;

c) means for biasing said first contact surface and said second contact surface towards each other whereby said first contact surface and said second contact surface are separated from each other by applying a force against said second contact surface; and d) said generally elongated member having an upper side, and said open forward portion being a longitudinal slot in said upper side of said generally elongated member, and said slot is open-ended at a forward end of said generally elongated member.

16. A connector comprising:

a) generally elongated member having a substantially elongated opening, said member having a hollow portion with an interior surface in communication with an open forward portion and a rearward portion;

b) means for connecting to an object, said means being positioned in said hollow portion, said means for connecting comprising a first contact surface and a second contact surface extending outwardly from said open forward portion of said generally elongated member;

c) means for slidably biasing said first contact surface and said second contact surface towards each other whereby said first contact surface and said second contact surface are separated from each other by applying a force against said second contact surface; and d) said generally elongated member having an upper side and said open forward portion being a longitudinal slot in said upper side of said generally elongated member, and wherein said open forward portion of said generally elongated member is a trough, and said rearward portion is substantially tubular shaped with an open end.

17. A battery jumper cable connector comprising:

a) generally elongated insulated member having a hollow portion with an interior surface in communication with an open forward portion and a rearward portion;

b) means for connecting to an object comprising conductive material being positioned in said hollow portion and comprising a first contact surface and a second contact surface extending outwardly from said open forward portion of said generally elongated member;

c) means for slidably biasing said first contact surface and said second contact surface towards each other whereby said first contact surface and said second contact surface are separated from each other by applying a force against said second contact surface;

d) means for attaching a means for conducting electric current to said means for connecting, said means for attaching being fastened to said means for connecting; and e) means for conducting electric current attached to said means for connecting, and wherein said means for connecting includes a generally elongate fixed element fastened to an interior surface of said hollow portion, said generally elongate fixed element having a forward end comprising said first contact surface.

18. A connector comprising:

a) generally tubular member having a substantially elongated opening, said member having a hollow portion with an interior surface in communication with an open forward portion and a rearward portion;

b) means for connecting to an object with said means being positioned in said hollow portion, and comprising a first contact surface and a second contact surface extending outwardly from said open forward portion of said generally tubular member; and c) means for slidably biasing said first contact surface and said second contact surface towards each other whereby said first contact surface and said second contact surface are separated from each other by applying a force against said second contact surface.

19. A battery jumper cable connector comprising:

a) generally elongated insulated member having a hollow portion with an interior surface in communication with an open forward portion and a rearward portion;

b) means for connecting to an object comprising conductive material being positioned in said hollow portion and comprising a first contact surface and a second contact surface extending outwardly from said open forward portion of said generally elongated member, said means for connecting including a generally elongate fixed element fastened to an interior surface of said hollow portion, said generally elongate fixed element having a forward end comprising said first contact surface, said forward end comprising a section extending substantially perpendicular from an elongate section of said generally elongate fixed element;

c) means for biasing said first contact surface and said second contact surface towards each other whereby said first contact surface and said second contact surface are separated from each other by applying a force against said second contact surface;

d) means for attaching a means for conducting electric current to said means for connecting, said means for attaching being fastened to said means for connecting; and e) means for conducting electric current attached to said means for connecting.

20. The battery jumper cable connector of claim 19, wherein said forward end comprises a free end section inclined rearwardly from said section extending substantially perpendicularly from said elongate section.

21. A battery jumper cable connector comprising:

a) generally elongated insulated member having a hollow portion with an interior surface in communication with an open forward portion and a rearward portion, said generally elongated member having an upper side and said open forward portion is a longitudinal slot in said upper side of said generally elongated member, and slot longitudinal slot is open-ended at a forward end of said generally elongated member;

b) means for connecting to an object comprising conductive material being positioned in said hollow portion and comprising a first contact surface and a second contact surface extending outwardly from said open forward portion of said generally elongated member;

c) means for biasing said first contact surface and said second contact surface towards each other whereby said first contact surface and said second contact surface are separated from each other by applying a force against said second contact surface;

d) means for attaching a means for conducting electric current to said means for connecting, said means for attaching being fastened to said means for connecting; and e) means for conducting electric current attached to said means for connecting.

22. A battery jumper cable connector comprising:

a) generally elongated insulated member having a hollow portion with an interior surface in communication with an open forward portion and rearward portion;

b) means for connecting to an object comprising conductive material being positioned in said hollow portion and comprising a first contact surface and a second contact surface extending outwardly from said open forward portion of said generally elongated member, said means for connecting including a generally elongate fixed element fastened to an interior surface of said hollow portion, said generally elongate fixed element having a substantially hook-shaped forward end comprising said first contact surface;

c) means for biasing said first contact surface and said second contact surface towards each other whereby said first contact surface and said contact surface are separated from each other by applying a force against said second contact surface;

d) means for attaching a means for conducting electric current to said means for connecting, said means for attaching being fastened to said means for connecting; and e) means for conducting electric current attached to said means for connecting.

23. The battery jumper cable connector of claim 22, wherein said means for biasing comprises a resilient member interconnecting said generally elongate fixed element and said slide element.

24. The battery jumper cable according to claim 23, wherein said resilient member comprises a coil spring.

25. The battery jumper cable according to claim 24, wherein said coil spring comprises opposite free ends connected to said section extending substantially perpendicularly from said elongate section of said generally elongate fixed element, and said section extending substantially perpendicular from said slide section.

26. The battery jumper cable connector of claim 30, wherein said open forward end position of said generally elongated member is a trough, and said rearward position is substantially tubular shaped with an open end.

27. The battery jumper cable connector of claim 22, wherein said slide element comprises a slide section in contact with said elongate section.

28. The battery jumper cable connector of claim 27, wherein said slide element further comprises a section extending substantially perpendicularly from said slide section.

29. The battery jumper cable connector of claim 24, wherein said slide element further comprises a free, forwardly projecting end section extending from said section extending substantially perpendicularly from said slide section towards said free end section of said generally elongate fixed element.

30. A battery jumper cable connector comprising:

a) generally elongated insulated member having a hollow portion with an interior surface in communication with an open forward portion and a rearward portion, said generally elongated insulated member having an upper side and said open forward portion is a longitudinal slot in said upper side;

b) means for connecting to an object comprising conductive material being positioned in said hollow portion and comprising a first contact surface and a second contact surface extending outwardly from said open forward portion of said generally elongated member;

c) means for biasing said first contact surface and said second contact surface towards each other whereby said first contact surface and said second contact surface are separated from each other by applying a force against said second contact surface;

d) means for attaching a means for conducting electric current to said means for connecting, said means for attaching being fastened to said means for connecting; and e) means for conducting electric current attached to said means for connecting.

31. A battery jumper cable connector comprising:

a) generally elongated insulated member having a hollow portion with an interior surface in communication with an open forward portion and a rearward portion, said generally elongated insulated member having an upper side and said open forward portion is a longitudinal slot in said upper side, and said slot being open-ended at a forward end of said generally elongated member;

b) means for connecting to an object comprising conductive material being positioned in said hollow portion and comprising a first contact surface and a second contact surface extending outwardly from said open forward portion of said generally elongated member;

c) means for biasing said first contact surface and said second contact surface towards each other whereby said first contact surface and said second contact surface are separated from each other by applying a force against said second contact surface;

d) means for attaching a means for conducting electric current to said means for connecting, said means for attaching being fastened to said means for connecting; and e) means for conducting electric current attached to said means for connecting.

* * * * *